US007481433B1

(12) United States Patent
Karr et al.

(10) Patent No.: US 7,481,433 B1
(45) Date of Patent: Jan. 27, 2009

(54) POKER STYLE CARD GAME AND METHOD OF PLAY

(76) Inventors: Christopher Geane Karr, 7421 W. Luke Dr., Sioux Falls, SD (US) 57106; Shayn Arthur Damm, 3608 E. Dudley La., Sioux Falls, SD (US) 57103

( * ) Notice: Subject to any disclaimer, the term of this patent is extended or adjusted under 35 U.S.C. 154(b) by 277 days.

(21) Appl. No.: 11/352,853

(22) Filed: Feb. 13, 2006

(51) Int. Cl.
*A63F 1/00* (2006.01)

(52) U.S. Cl. ..... 273/292; 273/274; 463/13

(58) Field of Classification Search ..... 273/292, 273/274, 309; 463/13, 12
See application file for complete search history.

(56) References Cited

U.S. PATENT DOCUMENTS

| | | | | |
|---|---|---|---|---|
| 5,664,781 | A | 9/1997 | Feola | |
| 5,901,958 | A | 5/1999 | Andrews | |
| 5,921,550 | A | 7/1999 | Awada | |
| 5,988,643 | A | 11/1999 | Awada | |
| 6,048,267 | A | 4/2000 | Wichinsky | |
| 6,129,357 | A | 10/2000 | Wichinsky | |
| 6,206,780 | B1 | 3/2001 | Awada | |
| 6,270,405 | B1 | 8/2001 | Ferguson | |
| 6,311,979 | B1 * | 11/2001 | Andrews | 273/292 |
| 6,443,456 | B1 | 9/2002 | Gajor | |
| 6,454,266 | B1 | 9/2002 | Breeding et al. | |
| 6,478,675 | B1 | 11/2002 | Awada | |
| 6,638,163 | B2 | 10/2003 | Moody | |
| 6,705,943 | B2 | 3/2004 | Awada | |

OTHER PUBLICATIONS

Card Game Handout and CD screen prints by same inventor, 2004 (15 pages).

* cited by examiner

*Primary Examiner*—Benjamin H Layno
(74) *Attorney, Agent, or Firm*—McKee, Voorhees & Sease, P.L.C.

(57) ABSTRACT

A poker style card game apparatus and method which allows any or all players the opportunity to win any given round, and utilizes two hands played concurrently utilizing one or more shared card(s). The card game apparatus includes at least one deck of cards and a table. The table preferably includes a plurality of player stations, a community card indicia indicating the placement of one or more community cards to be used by all players equally in completing a small hand and a large hand. Each player utilizes the cards they are dealt, along with the community card(s) to form a large hand, preferably five cards, and a small hand, preferably three cards. A value of the hands formed by each player is then determined according to a payout schedule.

21 Claims, 3 Drawing Sheets

POKER STYLE CARD GAME AND METHOD OF PLAY

BACKGROUND OF THE INVENTION

1. Field of the Invention

The present invention relates to card games and more particularly pertains to a new poker style card game and method of play in which each player or all players may win any given round of play, is not affected by bluffing and allows the players to concurrently construct both a large poker hand and a small poker hand. In addition, a player can win with the dealt cards.

2. Description of the Prior Art

Many variations of card games and more specifically poker-style games are known and have been played for many decades if not centuries. The exact origins of poker-style games is a matter of opinion with cards games from Germany (Pochen), France (Poque), Persia (As Nas), India (Ganjifa), and China (card variation of dominoes) all contending for possible parenthood of poker. Modern poker in America most probably started in New Orleans and traveled up the Mississippi, being played on steamboats. The game quickly spread to the interior of the country on the wagon trains. The Civil War brought about variations in the game such as "stud" poker. In the early 20th century, "draw" poker rose to prominence.

In almost all variations of poker, one player plays against all other players. Bluffing can be a critical skill in successfully mastering the game. Additionally, it is possible for a player to play a hand well, and still lose, due to the player holding what amounts to the second best hand.

Examples of patented poker games include U.S. Pat. No. 6,454,266; U.S. Pat. No. 6,206,780; U.S. Pat. No. 5,901,958; U.S. Pat. No. 5,664,781; U.S. Pat. No. 6,048,267; U.S. Pat. No. 6,129,357; U.S. Pat. No. 6,443,456; U.S. Pat. No. 6,270,405; and U.S. Pat. No. 6,638,163.

In greater detail, U.S. Pat. No. 6,454,266 describes a card game with multiple opportunities to withdraw at least a portion of a player's bet as cards are revealed. Additionally, "wild" cards are randomly generated to introduce a further element of luck in the play, with all players' hands being influenced by the wild cards.

Another card game is presented in U.S. Pat. No. 6,206,780 which teaches a video poker machine for playing a five card stud poker hand, paying out according to a payout schedule and then allowing two additional cards to be added to the hand to create a seven card stud poker hand.

U.S. Pat. No. 5,901,958 teaches a method of playing a version of five card stud for up to seven players using two shared dealer cards with multiple betting opportunities.

U.S. Pat. No. 5,664,781 teaches a variant where the players serve as bankers against a predetermined number of hands shared by all. The player(s) selecting the best hand of the shared hands receives a payout, while all others pay into the house.

Both U.S. Pat. Nos. 6,048,267 and 6,129,357 teach multiple hand variations in which a player is dealt a partial first hand and then may select one of two additional cards to add to their hand (one face up or one face down). This process of selecting one of two cards is continued until three five card hands are dealt.

U.S. Pat. No. 6,443,456 teaches a video poker game in which players may wager on cards in horizontal rows, vertical columns, or two diagonal lines.

Yet another poker style game is taught in U.S. Pat. No. 6,270,405 in which the player initially receives three cards for a first hand, additional cards are then dealt and either selected to complete the first hand or moved to form a second hand. This process is repeated until the first hand is full. The player may then either select cards to complete the second hand or move the cards to form a third hand. This is continued until three hands are constructed.

U.S. Pat. No. 6,638,163 discloses an electronic stud poker game. In this game, the player is dealt a 5-card poker hand and is paid according to a pre-determined pay table. If the player wins, the player is paid and is allowed to continue for no additional wager. If the player has a losing hand, the game is over.

None of these games teaches a poker style game in which the player concurrently constructs a five card hand and a three card hand from four initially dealt cards.

SUMMARY OF THE INVENTION

The present invention provides a significant variation from known poker-style games, in which each player stands on their own ability to build the best possible poker hand, and all players may win any given round of the game.

Additionally, there is no hand dealt to the "house" or dealer. Each player uses their skill to build the best hands possible for each round of play.

Finally, each player knows what their potential payout is for any given combination of cards, without concern for having the second best hand.

To this end, one aspect of the present invention contemplates a method of playing a poker style game, which includes at least one deck of cards and a payout schedule detailing values of predetermined combinations of cards.

Further, the present invention also contemplates an apparatus for playing a poker-style game which generally comprises at least one deck of cards and a table. Preferably, the deck(s) of cards used each have four suits and thirteen cards per suit. The table includes a plurality of player stations. Each player station has a pair of indicia thereon comprising a small hand indicia, and a large hand indicia. Each player station is used for receiving cards dealt from the deck(s) of cards and a corresponding wager by a player located at the player station. The table also includes a dealer's station located generally opposite the player stations allowing the dealer to visually interact with the players. The table also preferably includes a community card indicia indicating the placement of at least one community card to be used by all players equally in completing a small hand and a large hand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
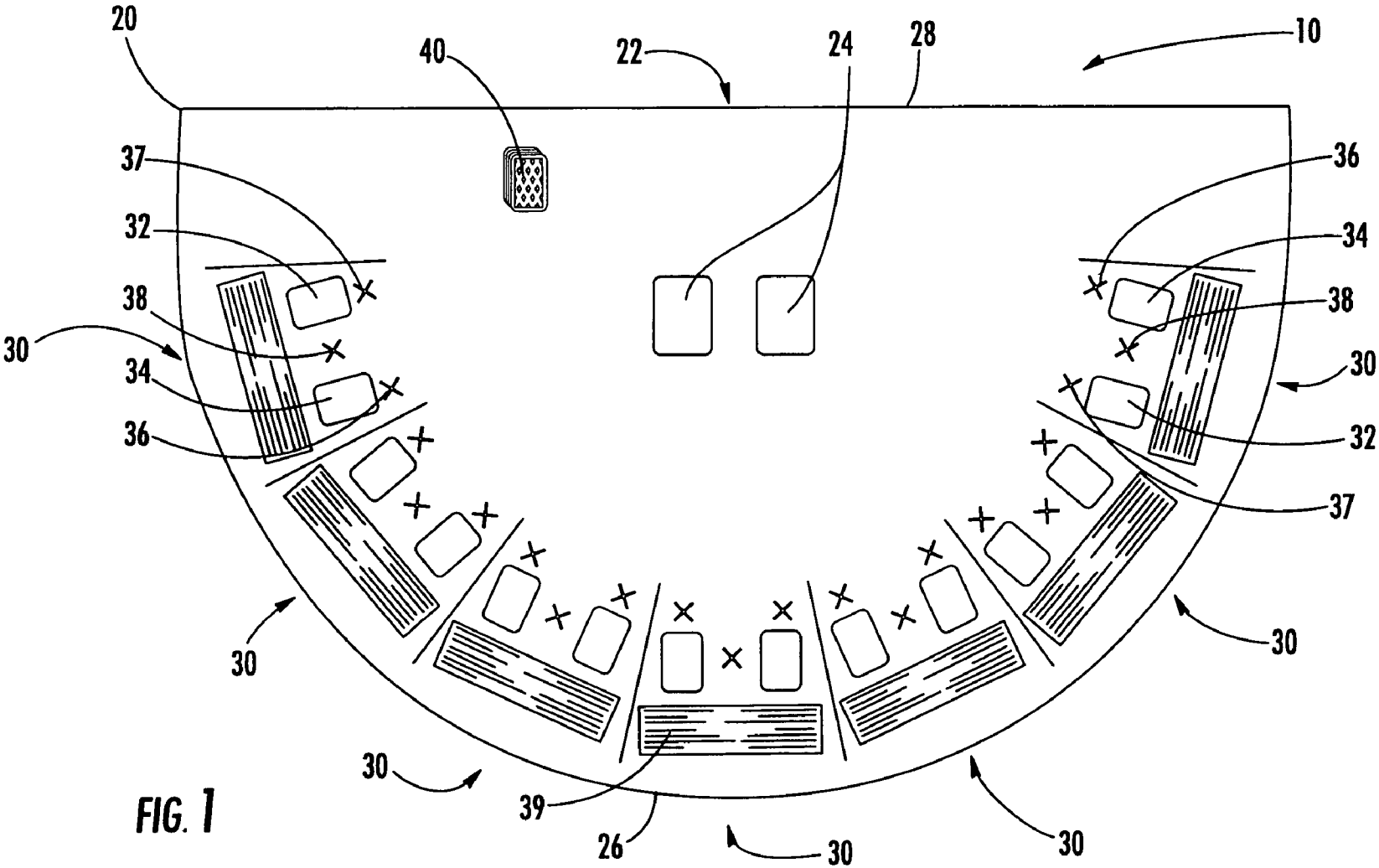
FIG. 1 is a plan view of the playing surface of a preferred embodiment of a new poker style card game according to the present invention.
Figure 2:
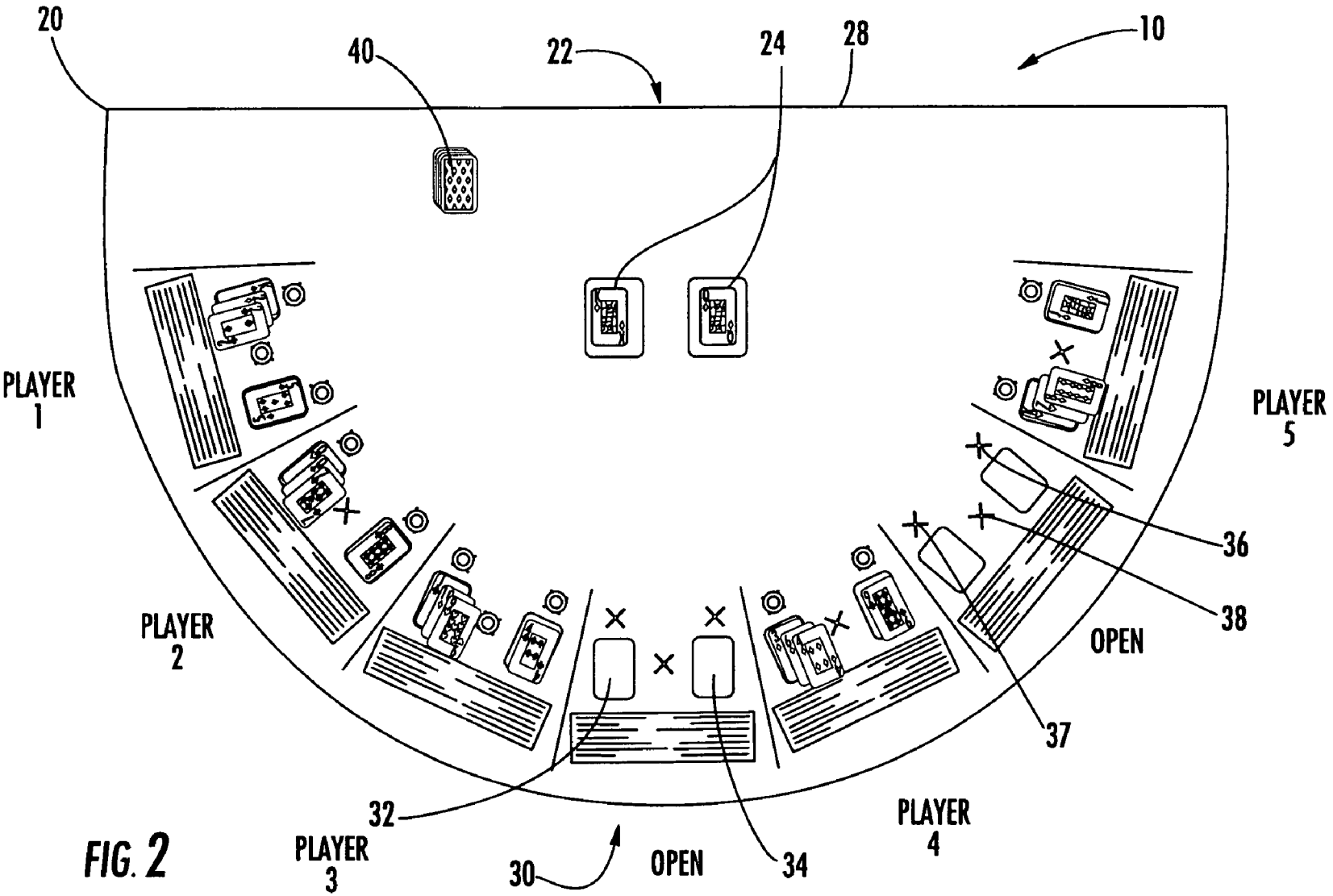
FIG. 2 is the playing surface of FIG. 1 during a game of play.
Figure 3:
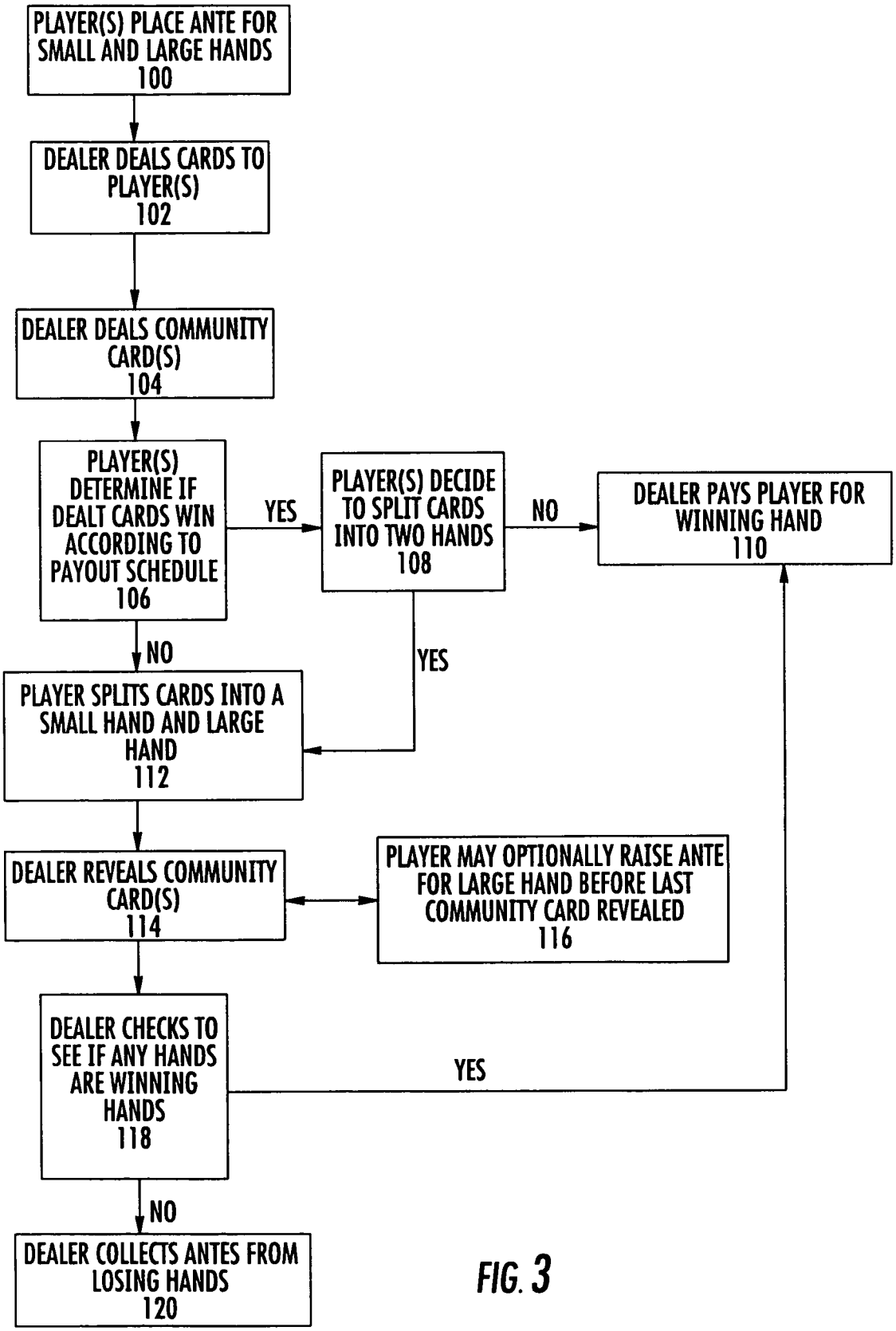
FIG. 3 is a flow chart of a preferred method of play of the present invention.

With reference now to the drawings, and in particular to FIGS. 1 through 3 thereof, a new poker style card game and method of play embodying the principles and concepts of the present invention will be described.

In one aspect of the invention a game playing apparatus 10 is provided which is highly suitable for use during play of the method of the invention. The apparatus generally comprises at least one deck 40 of cards and a table 20 having a playing surface. Each deck 40 of cards is preferably a standard deck of playing cards and has four suits and thirteen cards per suit as is commonly known in the art. However, any type or number of cards can be used.

The table 20 may have a plurality of player stations 30. Each player station 30 is used for receiving cards dealt from the deck(s) 40 of cards and a corresponding wager by a player located at the player station 30. Each player station 30 preferably may include a plurality of indicia including a small hand indicia 34, a large hand indicia 32, a first wager indicia 36, a second wager indicia 37, and a third wager indicia 38.

The small hand indicia 34 designates the location for receiving the card or cards selected by the player to be part of the player's smaller poker hand. Similarly the large hand indicia 32 designates the location for receiving the cards selected by the player to be part of the player's larger poker hand.

The first wager indicia 36 designates the positioning of a wager, preferably an ante, associated with the player's small poker hand. The second wager indicia 37 designates the positioning of a wager, preferably an ante, associated with the player's large poker hand. The third wager indicia 38 designates the positioning of an optional wager associated with the player's large poker hand.

Most preferably, each player station also includes a payout or winning schedule 39 for the reference of a player.

The table 20 may also include a dealer's station 22 located generally opposite the player stations 30, allowing the dealer to visually interact with the players. Within reach of the dealer's station 22 is preferably one or more community card indicia 24 indicating the placement of at least one community card to be used by all players equally in completing the player's small poker hands and large poker hands. This community card indicia 24 is preferably centrally located on the table to facilitate easy visual observation of the community cards by any one of the players during play.

In at least one embodiment, the table is substantially semicircular with each one of the plurality of player stations being dispersed along an arcuate side 26 of the table 20 and the dealer's station 22 is positioned along a straight side 28 of the table 20. The semicircular table allows players to visually interact with each other during play.

Although the game can be played by a single player as well as by multiple players, the preferred embodiment of the table includes seven playing stations.

In at least one version of play, each player puts in an ante for his or her large poker hand 100 and also for his or her small poker hand. The ante for the small poker hand is placed on the first wager indicia 36 and the ante for the large poker hand is placed on the second wager indicia 37. The dealer deals cards to the players in turn (one card to each of the players, then a second card to each of the players, etc), until each player has been dealt four cards 102. The dealer then deals two community cards face down 104 to the community card indicia 24.

Each player determines if their dealt cards are a winning hand 106, such as four-of-a-kind dealt or two-pair dealt, as shown in Table 2. The player must then decide if the player wants to split the winning cards into two separate hands, or if the player wants to accept payout of the winning hand 108. If the player accepts the winning hand as is, the dealer pays the player for the winning hand 110. On the other hand, if the player decides to split the cards into two hands, the player may do so. As an example, if the player is dealt a four-of-a-kind hand, the player is able to lay that hand face down and announce that the player has four-of-a-kind. The dealer will then pay the player a payout 110 on the large hand wager only. Another example is if the player has a two-pair dealt hand. This means that the player is dealt their four cards and the four cards are combination of two-pair of equal ranked cards. The player will have the opportunity to choose what they want to do with the hand 108. For example, the player has one-pair of twos and one-pair of fives, two-pair, the player can split the hand 112 as described below, and attempt to achieve a higher ranked hand on the large hand payout schedule. By doing this, the player will also be playing the small hand, which gives the player another opportunity to win. If the player does not feel that they have a chance to win by splitting their cards as described, they can lay this four-card hand face down and announce they have a two-pair dealt hand. The player will then be paid for the winning hand 110. The payout is according to the large hand only ante. The small hand wager is pushed back to the player for both the two-pair dealt hand and a four-of-a-kind dealt hand.

Each player must then determine which portion of the plurality of dealt cards is to be dedicated to the small poker hand, and which portion of the dealt cards is to be committed to the large poker hand. In one preferred implementation of the method, from the four cards dealt to the player, one of the dealt cards is committed by the player to the small poker hand (which is preferably, but not critically, a three-card hand) and which three of the dealt cards are committed by the player to the large poker hand (which is preferably, but not critically, a five-card hand). The player splits the dealt hand into a small hand and a large hand 112. The one card selected for the three-card hand is positioned by the player on the small hand indicia 34. Similarly, the player also positions the three remaining cards on the large hand indicia 32. The dealer then turns over the first one of the community cards 114. (The community cards are used to complete each player's small poker hand and large poker hand). Each player has the opportunity to raise their bet associated with the large poker hand 116 based upon their three original cards and the first community card. The raise is optional, but if made, the additional wager is placed on the third wager indicia 38. In one instance, the player is able to raise the bet equal or less than the original large hand wager. The dealer then reveals the second community card 114, checks to see if any hands are winning hands 118, pays off any winning hands 110 according to the payout schedule 39, and collects the wagers from all losing hands 120.

In order to illustrate at least some of the aspects of the skill applied to the present game, consider the following example hand dealt to a single player. Assume a player is dealt the 2, 3, 6, and 7 of hearts. The player must first decide how best to split the four cards dealt into a first subgroup of three-cards to be part of the five-card hand, and a second subgroup of one card to be part of the three-card hand. We will now examine three possible (although not the only) alternatives that the player may elect.

If the player selects the 3 of hearts for their three-card hand and leaves the 2, 6, and 7 for the five-card hand, he or she has eliminated to possibility of getting a straight flush in the five-card hand. Let us further assume that the community cards, dealt face down, indeed are the 4 and 5 of hearts. The result for the player would be a three-card hand which is a straight flush (3, 4, and 5 of hearts). Using the version "1" payout schedule (shown below in Table 2) this three-card hand would payoff at 15:1. The results of the five-card hand would be a flush (2, 4, 5, 6, and 7 of hearts) and again using the version "1" payout schedule would payoff at 7:1. The net result for the player, if money were to be used and an ante of $1 per hand put in, would be $22.00 from the $2.00 wagered.

Note, however, if the player instead selected the 2 of hearts for their three-card hand, the results would be greatly improved. The three-card hand would be a flush (2, 4, and 5 of hearts) and again using the version "1" payout schedule would payoff at 3:1. The five-card hand would be a straight flush which pays off at 100:1. Thus by selecting the 2 of hearts instead of the 3 of hearts for his or her three-hand card, the player has improved the results to a net of $103.00 from the $2.00 wagered.

Additionally if the player raised the bet on the five-card hand by $1.00 prior to the second community card being revealed, the net results would be $203.00 from a total of $3.00 wagered.

As can be seen from this simple illustrative example, the skill of the player can have a significant effect upon the outcome of the round of play.

Next, consider another round of play, using five players rather than the single player in the example used above. Assume the cards are dealt with the following results:

TABLE 1

Illustrative Hands As Dealt

| Player 1 | Player 2 | Player 3 | Player 4 | Player 5 |
|---|---|---|---|---|
| King - ♣ | Queen - ♥ | Jack - ♣ | 3 - ♦ | King - ♥ |
| 2 - ♦ | Queen - ♣ | 10 - ♦ | 6 - ♦ | 7 - ♥ |
| 2 - ♣ | 7 - ♣ | 9 - ♥ | 4 - ♦ | 8 - ♦ |
| 5 - ♣ | 8 - ♣ | 4 - ♣ | 9 - ♣ | Jack - ♦ |

Further, assume that each player antes $1.00 for each hand, and that the community cards as dealt are the King and Queen of Diamonds.

Player one could have two-pair in the five-cards hand (Kings and 2s) which pays out at 2:1. Even though the corresponding three-card hand is not a winner (King, Queen, 5), player one at least breaks even. If player one had doubled his wager on the five-card hand prior to the second community card being revealed, he would have won $4.00 on a total wager (across both hands) of $3.00.

Player two could have three-of-a-kind in the five-card hand (Queen, Queen, Queen and either the 7 or 8), which pays out at 3:1. The corresponding three-card hand is not a winner (King, Queen, and either the 7 or 8) but the player gets $3.00 on a total wager of $2.00. Again, if player two had doubled the bet on the five-card hand prior to the second community card being revealed, they would have won $6.00 on a total wager (across both hands) of $3.00.

Player three could have a straight in the five-card hand (King, Queen, Jack, 10, 9) which pays out at 5:1. The corresponding three-card hand is not a winner (King, Queen, 4), but the player gets $5.00 on a total wager of $2.00. Yet again if the player had doubled their bet on the five-card hand prior to the second community card being revealed, they would have won $10.00 on a total wager of $3.00.

Player four could have a flush in the five-card hand (King, Queen, 6, 4, and 3 of diamonds) which pays out at 7:1. Again the corresponding three-card hand is not a winner (King, Queen, 9) but the player gets $7.00 on a total wager of $2.00. If the player had doubled the bet on the five-card hand prior to the second community card being revealed, the player would have won $14.00 on a total wager of $3.00.

Player five could have a pair of kings in the five-card hand (King, Queen, King, 7 and 8) that pays out at 1:1, and a three-card hand that is a straight flush (King, Queen, Jack) that pays out at 15:1. The net result for player five could be $16.00 on a total wager of $2.00. In the case of player five, both the five-card and the three-card hands are winners.

As can be seen by this second illustrative example, it is possible for each player (all players) to win during the round of play, without regard to the cards dealt to another player, what any other player does, or any other player's results. This ability for each round of play to have multiple winners is one aspect of the game which provides additional appeal for the players. Additionally, no player is limited by his or her ability to bluff other players or susceptibility to be bluffed by other players.

Further, the game easily accommodates payout schedules being adjusted by the house to either restrict payout or provide a more generous payout schedule allowing for competitive differences between houses or gaming establishments. While the payout schedules can be adjusted without departing from the spirit of the present invention, three preferred payout schedules are in Table 2 as follows:

TABLE 2

Preferred Payment Schedules

| Hand Type | Version 1 | Version 2 | Version 3 |
|---|---|---|---|
| | 5-card Hand Pay Tables | | |
| Royal Flush | 200 | 500 | 200 |
| Straight Flush | 100 | 100 | 100 |
| 4 of a Kind dealt | 50 | 50 | 50 |
| 4 of a Kind | 15 | 20 | 20 |
| Full House | 9 | 9 | 9 |
| Flush | 7 | 7 | 7 |
| Straight | 5 | 5 | 5 |
| 3 of a Kind | 3 | 3 | 3 |
| Two-pair | 2 | 2 | 2 |
| Two-pair dealt | 1 | 1 | 1 |
| Pair of Jacks or better | 1 | 1 | 1 |
| | 3-card Hand Pay Tables | | |
| Straight Flush | 15 | 15 | 15 |
| 3 of a Kind | 8 | 8 | 10 |
| Straight | 4 | 4 | 4 |
| Flush | 3 | 3 | 3 |
| One Pair | 1 | 1 | 1 |

In at least one embodiment of the game, the game is automated in the form of a video machine, a media-based computer version, or an internet-based game. In this electronic embodiment, the playing surface is replaced by a display means such as a computer monitor, television screen, projected image, or other suitable device. A computing device is used to generate the symbols for the electronic version-of the cards, and generates the cards in a pseudo-random fashion simulating the dealing of shuffled cards. The computing device may be a traditional personal computer (especially in the case of a media-based computer version), a DVD player for presenting a DVD-based media which may be limited to a predetermined series of rounds, a server for hosting internet-based versions, or other suitable devices such as hand held computers, PDA's, cellphones, or other "smart" personal electronics.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of playing a poker style game between a dealer and one or more players, comprising:

providing a deck of cards;

providing a winning schedule for predetermined combinations of cards;

dealing cards from the deck of cards to each player until at least three cards have been dealt to each player;

dealing one or more community card(s) to be used by each player as part of their respective poker hands;

allowing each player to determine whether the cards dealt to that player win by that player's dealt cards being one of the predetermined combination of cards by all being equally ranked cards or by being two-pair of equally ranked cards and giving each player a choice of either stopping play at that time and be paid if the initial cards dealt to the player form a winning predetermined combination, or allowing each player that received a winning predetermined combination to continue play and not be paid for the initial cards having a winning predetermined combination;

allowing each remaining player that decided to continue to play to split the cards dealt to that player into two subsets, a first subset of cards having a number of cards to be part of a large poker hand, and a second subset of cards having a number of cards less than the first subset of cards to be part of a small poker hand; and allowing each remaining player that decided to continue play to form the large poker hand using the number of cards that form the part of the large poker hand and using the one or more community cards and to form the small poker hand using the number of cards that form the part of the small poker hand and using the one or more community cards;

determining any winnings by the players according to the winning schedule for predetermined combinations of cards.

2. The method of claim 1 further comprising the step of providing a table having a plurality of player stations.

3. The method of claim 1 wherein said small poker hand includes fewer cards than said large poker hand.

4. The method of claim 1 further comprising the step of allowing each player to bet an ante prior to dealing the cards from the deck of cards to each of the players.

5. The method of claim 1 further comprising the step of allowing an optional wager by each remaining player in turn prior to the step of revealing a last community card.

6. The method of claim 1 additionally comprising forming said small poker hand from three cards including a single card dealt to the player and two community cards.

7. The method of claim 1 additionally comprising forming said large poker hand from five cards including three cards dealt to the player and two community cards.

8. The method of claim 1 wherein dealing cards is performed by a person.

9. The method of claim 1 wherein dealing cards is performed by a computing device.

10. The method of claim 1 wherein dealing cards is performed by a mechanical shuffler.

11. A method of playing a poker style game comprising:

providing a deck of cards;

providing a payout schedule detailing values of predetermined combinations of cards;

providing a playing surface having at least one player station, each player station having a small hand indicia, a large hand indicia, and a community card indicia positioned on said playing surface;

allowing an ante wager by each player;

dealing cards from the deck of cards to each player until at least three cards have been dealt to each player;

allowing each player to determine whether the cards dealt to that player win by that player's dealt cards being 4 of a kind or by being two-pair and giving each player a choice of either stopping play at that time and be paid if the initial cards dealt to the player form 4 of a kind or two-pair, or allowing each player that received a 4 of a kind or a two-pair to continue play and not be paid for the initial cards having a 4 of a kind or a two-pair;

allowing each remaining player that decided to continue to play to split the cards dealt to that player into two subsets, a first subset of cards having a number of cards to be part of a large poker hand, and a second subset of cards having a number of cards less than the first subset of cards to be part of a small poker hand; and allowing each remaining player that decided to continue play to form the large poker hand using the number of cards that form the part of the large poker hand and using the one or more community cards and to form the small poker hand using the number of cards that form the part of the small poker hand and using the one or more community cards;

dealing a pair of community cards;

revealing a first one of the pair of community cards;

allowing an optional wager by each player remaining prior to revealing a second one of the pair of community cards;

revealing the second one of the pair of community cards; and determining any winnings by the players according to the payout schedule detailing values of predetermined combinations of cards.

12. The method of claim 11 additionally comprising forming said small poker hand from three cards including a single card dealt to the player and the pair of community cards.

13. The method of claim 11 additionally comprising forming said large poker hand from five cards including three cards dealt to the player and the pair of community cards.

14. The method of claim 11 wherein the pair of community cards form a part of both the small poker hand and the large poker hand.

15. The method of claim 14 wherein the small poker hand further comprises one of the cards dealt to the player making a three-card small poker hand and the large poker hand further comprises three of the cards dealt to the player making a five-card large poker hand.

16. The method of claim 11 wherein said playing surface is depicted on a display means operationally coupled to a computing means.

17. The method of claim 11 wherein said step of determining winners according to the payout schedule further comprises:

paying for any wager on a player's large poker hand if the large poker hand is a royal flush;

paying for any wager on a player's large poker hand if the large poker hand is a straight flush;

paying for any wager on a player's large poker hand if the dealt cards are four-of-a-kind dealt;

paying for any wager on a player's large poker hand if the large poker hand is a four-of-a-kind;

paying for any wager on a player's large poker hand if the large poker hand is a full house;

paying for any wager on a player's large poker hand if the large poker hand is a flush;

paying for any wager on a player's large poker hand if the large poker hand is a straight;

paying for any wager on a player's large poker hand if the large poker hand has three of a kind;

paying for any wager on a player's large poker hand if dealt cards have two-pair dealt;

paying for any wager on a player's large poker hand if the large poker hand has two-pair;

paying for any wager on a player's large poker hand if the large poker hand has a pair of jacks or better;

paying for any wager on a player's small poker hand if the small poker hand is a straight flush;

paying for any wager on a player's small poker hand if the small poker hand has three of a kind;

paying for any wager on a player's small poker hand if the small poker hand is a straight;

paying for any wager on a player's small poker hand if the small poker hand is a flush;

paying for any wager on a player's small poker hand if the small poker hand has any pair;

collecting wagers associated with all non-winning hands.

18. The method of claim 11 wherein dealing cards is preformed by a person.

19. The method of claim 11 wherein dealing cards is preformed by a computing device.

20. The method of claim 11 wherein dealing cards is preformed by a mechanical shuffler.

21. The method of claim 11 wherein dealing cards is preformed by a shuffling device, including but not limited to a mechanical shuffler.

* * * * *